US011592024B2

(12) United States Patent
Aubert et al.

(10) Patent No.: US 11,592,024 B2
(45) Date of Patent: Feb. 28, 2023

(54) MULTI-STAGE ROTARY VANE PUMP

(71) Applicant: Leybold GmbH, Cologne (DE)

(72) Inventors: Jean-Francois Aubert, Soyons (FR); Christophe Despesse, St-Romain-de-Lerps (FR)

(73) Assignee: LEYBOLD GMBH, Cologne (DE)

( * ) Notice: Subject to any disclaimer, the term of this patent is extended or adjusted under 35 U.S.C. 154(b) by 322 days.

(21) Appl. No.: 15/762,622

(22) PCT Filed: Sep. 20, 2016

(86) PCT No.: PCT/EP2016/072227
§ 371 (c)(1),
(2) Date: Mar. 23, 2018

(87) PCT Pub. No.: WO2017/055129
PCT Pub. Date: Apr. 6, 2017

(65) Prior Publication Data

US 2018/0298902 A1 Oct. 18, 2018

(30) Foreign Application Priority Data

Oct. 2, 2015 (DE) ..... 202015006922.3
Aug. 26, 2016 (DE) ..... 202016005229.3

(51) Int. Cl.
*F04C 23/00* (2006.01)
*F04C 25/02* (2006.01)
(Continued)

(52) U.S. Cl.
CPC ..... *F04C 23/003* (2013.01); *F04C 18/344* (2013.01); *F04C 23/001* (2013.01);
(Continued)

(58) Field of Classification Search
CPC F04C 18/344; F04C 2240/20; F04C 2240/30; F04C 2240/60; F04C 23/001;
(Continued)

(56) References Cited

U.S. PATENT DOCUMENTS 2,462,732 A 2/1949 Dusevoir
3,178,102 A 4/1965 Grisbrook
(Continued)

FOREIGN PATENT DOCUMENTS

CN 103498795 A 1/2014
DE 9311986 U1 10/1993
(Continued)

OTHER PUBLICATIONS

English Machine Translation of CN103498795A. (Year: 2008).*
(Continued)

*Primary Examiner* — Essama Omgba
*Assistant Examiner* — Paul W Thiede
(74) *Attorney, Agent, or Firm* — Ohlandt, Greeley, Ruggiero and Perle, LLP

(57) ABSTRACT

A multi-stage rotary vane pump comprising at least two rotor elements. The rotor elements are supported by a rotor shaft. The rotor elements and the rotor shaft are in the form of a single piece.

16 Claims, 4 Drawing Sheets

(51) Int. Cl.
*F04C 18/344* (2006.01)
*F04C 29/02* (2006.01)

(52) U.S. Cl.
CPC ..... *F04C 25/02* (2013.01); *F04C 29/026* (2013.01); *F04C 2240/20* (2013.01); *F04C 2240/30* (2013.01); *F04C 2240/60* (2013.01)

(58) Field of Classification Search
CPC ..... F04C 23/003; F04C 25/02; F04C 29/026; F04C 13/007; F04C 11/00; F04C 11/0001; F01C 21/108; F01C 21/08
USPC ..... 418/13, 35, 88, 30, 31, 134, 152, 178, 418/179, 181, 210; 62/402
See application file for complete search history.

(56) References Cited

U.S. PATENT DOCUMENTS 3,438,570 A * 4/1969 Bergisch ..... F04C 23/001 418/13
3,744,942 A 7/1973 Mount
3,956,904 A * 5/1976 Edwards ..... F01C 1/3442 62/402
5,100,308 A * 3/1992 Gevelhoff ..... F01C 21/102 418/152
5,242,280 A * 9/1993 Fujio ..... F04C 18/3564 418/11
5,322,424 A * 6/1994 Fujio ..... F04C 18/3564 418/11
5,769,617 A 6/1998 Glen
5,879,138 A * 3/1999 Arndt ..... F01C 21/08 417/244
6,086,347 A * 7/2000 Ryska ..... F01C 1/3442 418/212
6,217,564 B1 * 4/2001 Peters ..... A61M 39/1011 604/111
6,361,293 B1 * 3/2002 Harper ..... F04C 23/008 417/312
7,108,492 B2 9/2006 Yamamoto et al.
7,485,163 B2 * 2/2009 Yoshimoto ..... B01D 46/0068 137/15.1
8,251,683 B2 8/2012 Byun et al.
8,985,956 B2 * 3/2015 Hogberg ..... F01D 5/284 416/193 R
2004/0208768 A1 * 10/2004 Yap ..... F04C 23/001 418/60
2009/0139262 A1 * 6/2009 Takahashi ..... F01C 21/04 62/468
2010/0183467 A1 * 7/2010 Sundheim ..... F04C 13/007 418/88
2010/0226808 A1 9/2010 Schofield et al.
2015/0167598 A1 * 6/2015 Yasuzaka ..... F04C 23/003 73/40.7

FOREIGN PATENT DOCUMENTS

DE 602004004693 T2 11/2007
EP 0711384 A1 5/1996
EP 2060790 A1 5/2009
FR 2353729 A1 12/1977
JP S5778793 U 5/1982
JP S62101896 A 5/1987
JP 401211684 A * 8/1989
JP H11230060 A 8/1999
JP 2004300970 A 10/2004
JP 2015113723 A 6/2015
WO 2011087457 A1 7/2011

OTHER PUBLICATIONS

English Machine Translation of EP 0711384B1 (Year: 1994).*
Derwent English Abstract of JP401211684A. (Year: 1989).*
International Search Report dated Feb. 2, 2017 for PCT application No. PCT/EP2016/072227.
Japanese Office Action (with English translation) dated Apr. 20, 2021 for Japanese application No. 2018-515865.
Japanese Office Action (with English translation) dated Jan. 28, 2022 for Japanese application No. 2018-515865.

* cited by examiner

MULTI-STAGE ROTARY VANE PUMP

BACKGROUND

1. Field of the Disclosure

The disclosure relates to a multi-stage rotary vane pump.

2. Discussion of the Background Art

Rotary vane pumps comprise a usually cylindrical rotor element which is arranged eccentrically in a suction chamber that is also of a cylindrical shape. The rotor element has a plurality of sliding vanes, usually three sliding vanes, connected to it. These sliding vanes are arranged in slots and are displaceable substantially in radial direction. Outer edges of the sliding vanes are arranged in abutment on the interior of the suction chamber. At an inlet of the suction chamber, a chamber formed adjacent to the sliding vane has a large volume. Due to the eccentricity, this volume will decrease continuously all the way to the outlet when the rotor element is rotated in the suction chamber. Thereby, the conveyed gas will be compressed. Further, a rotary vane pump of the multi-stage type is known. In these pumps, the inlet of a first stage is connected to a chamber which is to be evacuated, and the outlet of the first stage is connected to the inlet of the second stage, the outlet of the latter being in turn connected e.g. to the atmosphere.

A two-stage rotary vane pump of this type is described e.g. in EP 0 711 384. In this pump, the two rotors of the two stages are mounted on a common shaft. Between the two rotors, a circular partition wall is arranged. The rotor shaft is supported in a housing by ball bearings or bushings. Especially because of the large number of component parts, assembly of such a multi-stage rotary vane pump is complicated and expensive.

It is an object of the disclosure to provide a multi-stage rotary vane pump which can be manufactured at low cost.

SUMMARY

The multi-stage rotary vane pump of the disclosure comprises at least two rotor elements, each of them comprising a sliding vane displaceably arranged in a slot. The rotor elements are carried by a common rotor shaft. Further a respective suction chamber is provided for each rotor element. The rotor shaft, comprising rotor elements particularly of a cylindrical design, is arranged eccentrically to the suction chambers. Thus, a pump stage is formed by a suction chamber in which there is arranged a rotor comprising sliding vanes and mounted on a shaft.

According to the disclosure, the rotor elements are formed in one piece together with the rotor shaft. Thus, in the multi-stage rotary vane pump of the disclosure, it is not necessary anymore to mount the individual rotor elements on the rotor shaft. This allows for a considerable reduction of the technical expenditure for assembly. Further, also the costs for manufacture and assembly are reduced. Further, the need for assembly tolerances between the individual rotor elements to be mounted on the rotor shaft and the resultant inaccuracies can be avoided.

Between two pump stages, a partition wall is arranged for separating adjacent pump stages. To allow for a simple mounting process, the partition wall is of a multi-part design, particularly a two-part design. Thus, the partition wall comprises a plurality of partition wall elements, particularly two partition wall elements. In the assembled state, the partition wall elements comprise an opening which particularly has a round shape and preferably is arranged eccentrically, said opening having the rotor shaft extending through it. It is particularly preferred that the individual partition wall elements are shaped as ring segments. Particularly, the preferred embodiment—just as the outer circumference—of the partition wall is circular. In the preferred embodiment wherein two partition wall elements are provided, it is particularly preferred that these are substantially identical and are each half-ring-shaped. Particularly in case of an identical design of the two partition wall elements, the production costs are further lowered. Also the assembly process is facilitated thereby because no confusion between these components is possible.

Further, it is preferred that centering elements such as e.g. centering spigots or centering pins, are provided on the abutment face of the partition wall elements. Said halves can also consist of fracturized parts which are held together only by two screws.

According to a particularly preferred embodiment of the disclosure, the suction chambers are formed by a common one-pieced housing element. The at least two suction chambers can have the same diameter or different diameters. The corresponding diameter can also be the diameter of the at least one partition wall which in the mounted state forms a circular ring. Particularly, the arrangement comprises a cylindrical opening in the housing element in which at least one partition wall is arranged, thus forming the two suction chambers.

Further, it is preferred that the one-pieced rotor, i.e. the rotor shaft with the rotor elements, as well as also the mounted sliding vanes, will be pre-mounted together with the at least one partition wall. This pre-mounted component can then be inserted in axial direction into the housing element forming the suction chambers. Said one-pieced housing element can have further housing elements connected to it which preferably comprise the electric motor, the control unit, the cooling device, the oil feed device or the like.

The multi-stage rotary vane pump comprises a first rotor element arranged in a first suction chamber, and a—in flow direction—last rotor element arranged in a last suction chamber. The first suction chamber is connected to the pump inlet and the last suction chamber is connected to the pump outlet. The pump outlet is connected to an oil reservoir, wherein, through the pump outlet, the medium which due to the oil lubrication of the rotary sliding vanes has been enriched with oil, will be discharged. Between the outlet and the oil reservoir, there is normally arranged a valve such as e.g. a flap valve which preferably is situated at least partially below the oil level so that the oil will seal the valve.

According to a particularly preferred embodiment, there will occur, immediately in the oil reservoir, a separation of the oil from the conveyed gaseous medium. For this purpose, it is particularly preferred that the oil reservoir comprises two mutually connected cambers. Preferably, in this arrangement, one of the chambers is formed as an oil chamber and the other chamber as a filtering chamber. The two chambers are arranged behind each other in flow direction and will have the flow passing through them one after the other. Thereby, the mixture of oil and compressed gas will first be conducted into the oil chamber. Within the latter, a large part of the oil will be separated from the gas already under the effect of gravity. Subsequently, the gas/oil mixture will flow into the filtering chamber, wherein, particularly, the filtering chamber comprises a filtering device connected to the inlet of the filtering chamber. This filter serves for further separation of oil. Via a return flow channel, the oil will return again into the oil circuit of the pump. Particularly, the return flow channel is connected to the chamber.

The disclosure will be explained in greater detail hereunder by way of a preferred embodiment which a two-stage rotary vane pump.

DETAILED DESCRIPTION OF THE PREFERRED EMBODIMENT

Figure 1:
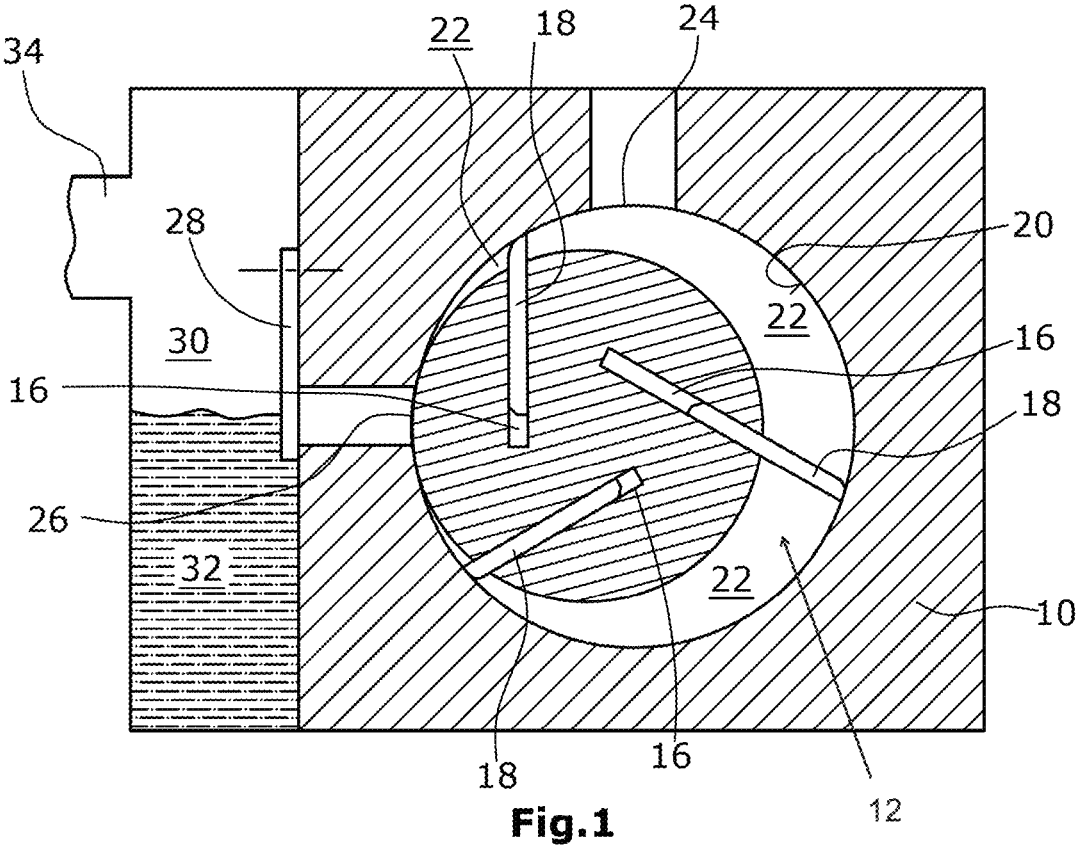
FIG. 1 is a schematic sectional view of a two-stage rotary vane pump.
Figure 5:
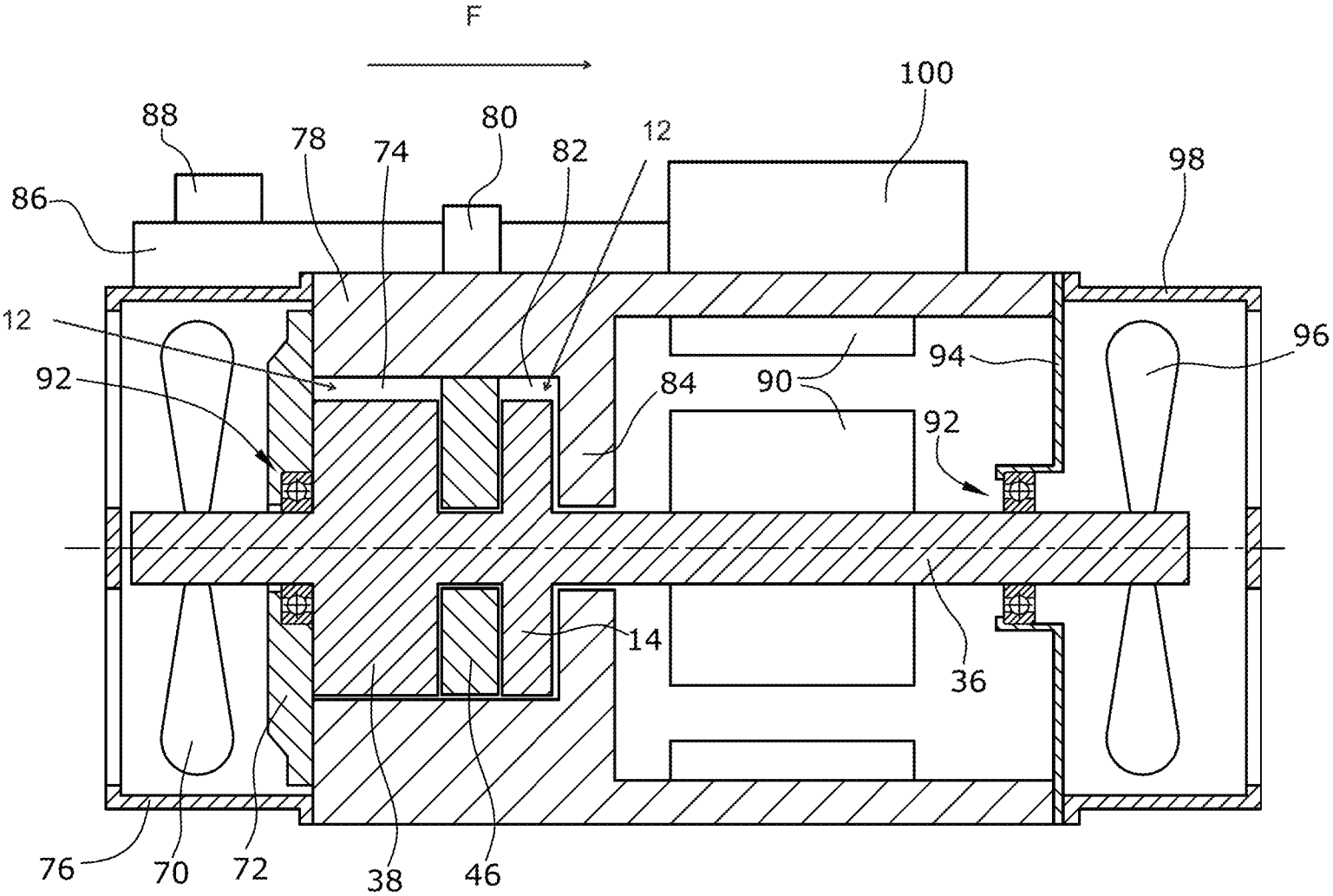
FIG. 5 is a schematic sectional view, as viewed in longitudinal direction, of a further preferred embodiment of the rotary vane pump.

A rotary vane pump comprises, within a housing element 10, two mutually coaxial suction chambers 12 in FIG. 1 and are shown situated behind each other in FIG. 5 as chambers 74 and 82. In each suction chamber 12, a rotor element 14 is arranged eccentrically to the cylindrical suction chamber 12. Each rotor element 14 carries, in substantially radial slots 16, a respective sliding vane 18. The sliding vanes 18 are in abutment on an inner wall 20 of suction chamber 12 and are pressed in the direction toward said inner wall 20 particularly by centrifugal forces. Between two adjacent sliding vanes, respective chambers 22 are formed whose size decreases starting from an inlet 24 to an outlet 26 when the rotor element 14 Is rotating within suction chamber 12. At the outlet 26, a valve, e.g. in the form of a leaf valve 28, is arranged so as to avoid backflow of the conveyed medium into suction chamber 12. Said leaf valve can be arranged in an oil chamber 30, wherein an oil level of the oil 32 partially covers the leaf valve 28 for sealing. The conveyed medium will be discharged from oil chamber 30 via an outlet filter element and an outlet 34 since the stage of a rotary vane pump shown in FIG. 1 is the second and respectively last stage. The provision of an outlet filter element allows for an oil-free outlet gas. In a first stage, the channel provided at the outlet 26 is also connected to the inlet 24 of the next and respectively second stage.

According to the disclosure, a rotor shaft 36 (FIG. 2) is formed in one piece with the two rotor elements 14, 38. The rotor element 14 is the rotor element arranged in the second pump stage (FIG. 1). The rotor element 38 arranged at the first pump stage is of a cylindrical shape corresponding to rotor element 14. Due to the larger width and/or the larger diameter of rotor element 38, the chambers of the first pump stage are larger than the chambers 22 (FIG. 1) of the second pump stage.

Apart from that, these elements are technically identical. Particularly, also the sliding vane, except for its larger width and height, is similar to the design of the sliding vanes 18.

The rotor shaft 36 can be of a multi-stepped design and serve e.g. for taking up hearing rings of the ball bearings or bushings. Corresponding bearing seats are formed herein particularly by the sections 40 of rotor shaft 36. In a section 42 of rotor shaft 35, e.g. the electric motor can be arranged. Further, in a section 44, e.g. a blower wheel can be arranged.

Figure 3:
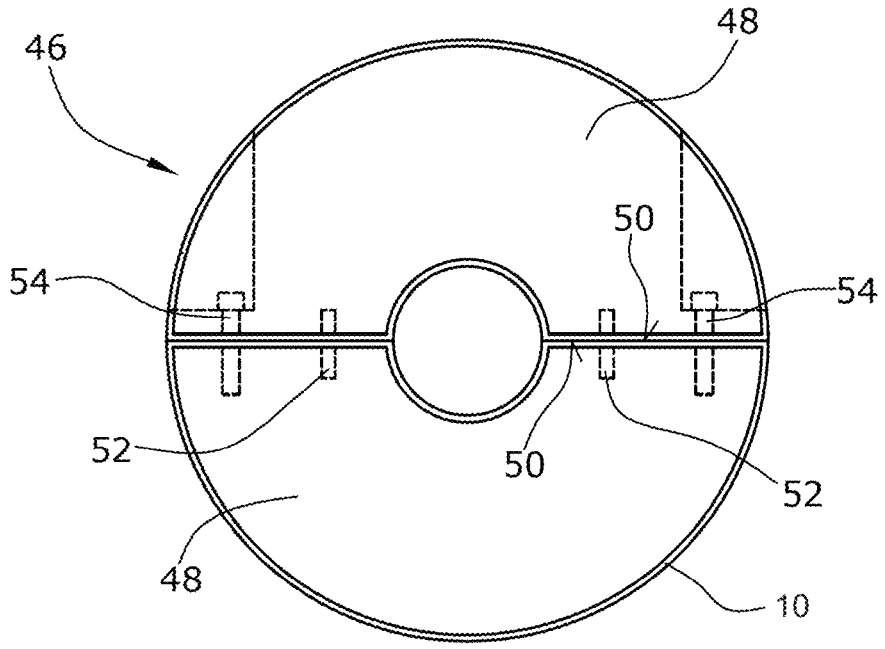
FIG. 3 is a schematic perspective view of a two-part partition wall.

Between the two rotor elements 14, 38, a partition wall 46 (FIG. 3) is arranged. In the particularly preferred embodiment illustrated herein, the partition wall 46 comprises two partition wall elements 48. The two partition wall elements are each designed as a half-ring-shaped element. On the two abutment faces 50 of the two partition wall elements 48 which in the assembled state are in abutment against each other, centering elements in the form of centering pins 52 are provided within openings. The halves can also be produced by fracturation. Additionally, for further mounting, two fastening elements in the form of screws 54 are provided. In the illustrated exemplary embodiment, these are accessible via openings provided in the upper partition wall element 48.

Figure 4:
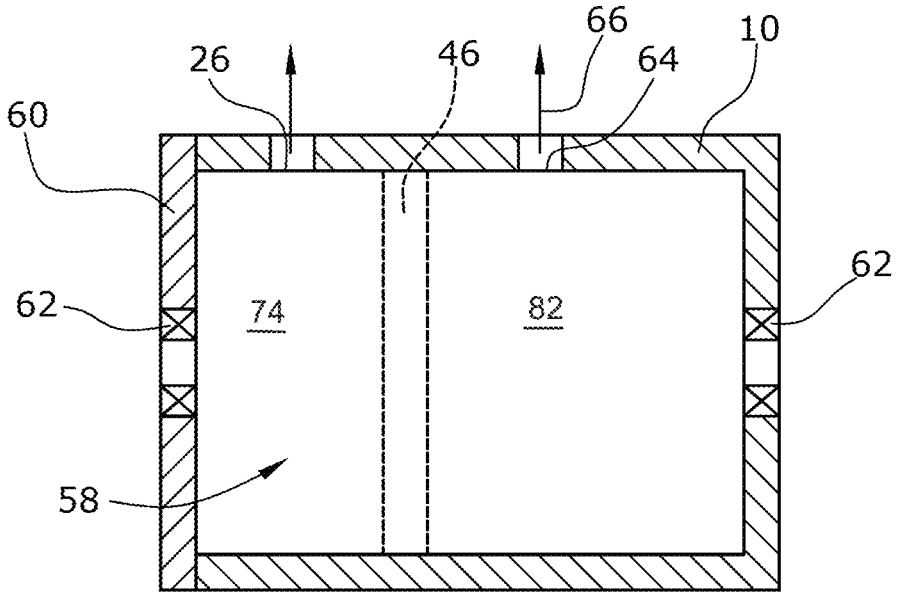
FIG. 4 is a schematic sectional view, as viewed in longitudinal direction, of a housing element forming the suction chambers.

The housing element 10, as schematically shown in FIG. 4, is of a one-pieced design. Thus, the housing 10 comprises a cylindrical cavity 58. The latter is closed by a housing lid 60. In the housing lid 60 and in the opposite wall of housing element 10, ball bearings or bushings 62 are arranged for support of rotor shaft 36. In the illustrated sectional view of housing element 10, also the two outlets can be seen. These are, on the one hand, the outlet 26 of the second pump stage and an outlet 64 of the first pump stage. Said outlet 64 will convey medium as indicated by arrow 66 and is connected to the inlet—not visible in FIG. 4—of the second stage. For clarification, the position of partition wall 46 in the mounted state is illustrated by an interrupted line. By partition wall 46, the two suction chambers 74 and 82 of the two pump stages are separated from each other.

Figure 2:
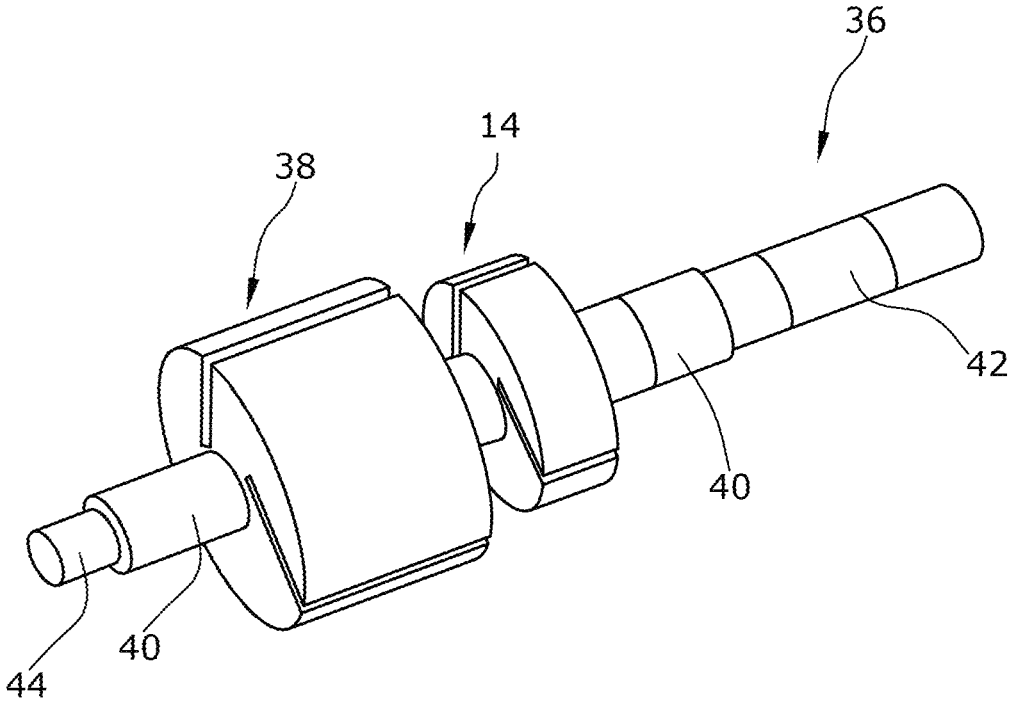
FIG. 2 is a schematic perspective view of a one-pieced rotor shaft comprising two rotor elements.

For assembly, the individual sliding vanes will be inserted into the slots of the two rotor elements 14, 38 (FIG. 2). Subsequently, the partition wall 46 will be mounted between the two rotor elements 14, 38. Then, this assembly will be inserted, in FIG. 4, from the left-hand side into the cylindrical opening 58 formed by housing element 10. Thereupon, the sliding vanes of the second stage will be mounted. Then, in the next step, the housing lid 60 will be mounted. This step is followed by mounting the other component parts of the vacuum pump, thus realizing a very simple and inexpensive mounting process.

A preferred embodiment of a rotary vane pump of the disclosure (FIGS. 5 and 6) comprises the rotor shaft 36 with two rotor elements 14, 38 as described above particularly with reference to FIGS. 1 and 2, wherein the rotor shaft 36 and the rotor elements 14, 38 are formed in one piece. Arranged between the two rotor elements 14, 38 is the two-part partition wall 46 shown in FIG. 3. Further, rotor shaft 36 carries a first blower wheel 70 on the left-hand side in FIG. 5. On the left-hand side, there is further arranged an interior housing lid 72 by which the suction chamber 74 accommodating the larger rotor element 38 is axially closed. Between said interior housing lid 72 and the shaft 36, a shaft sealing is arranged, not shown in greater detail here. The blower 70 is surrounded by a blower housing 76. The latter is open on the left-hand side in FIG. 5 and respectively comprises slotted openings. Further, said blower housing 76 is connected to a housing 78 of the pump.

On a top side of the housing, a pump inlet 80 is provided which is connected to the larger suction chamber 74.

For axial closure of the smaller suction chamber 82, the housing 78 comprises an inwardly projecting wall 84 which again is sealed against shaft 36.

The smaller suction chamber 82 which is the last one as viewed in flow direction (F) is connected, via an outlet conduit, to an oil reservoir, as illustrated in FIG. 1. In the illustrated exemplary embodiment, said oil reservoir is arranged laterally next to the pump, i.e. in FIG. 5 behind the pump, as oil reservoir 86. Thus, the medium to be used will be discharged into oil reservoir 86 and will then reach an outlet 88.

Further, an electric motor 9 is connected to rotor shaft 36.

Rotor shaft 36 is supported, via bearing elements 92, in an interior bearing plate 72 and respectively 94.

In the illustrated exemplary embodiment, on the right-hand side of FIG. 5, a further blower 96 is connected to rotor shaft 36. Also this blower is surrounded by a blower housing 98. At a top side of pump housing 78, a control device 100 is provided for control of the electric motor and of the other component parts of the vacuum pump. Said control device can further be connected to sensors etc.

Figure 6:
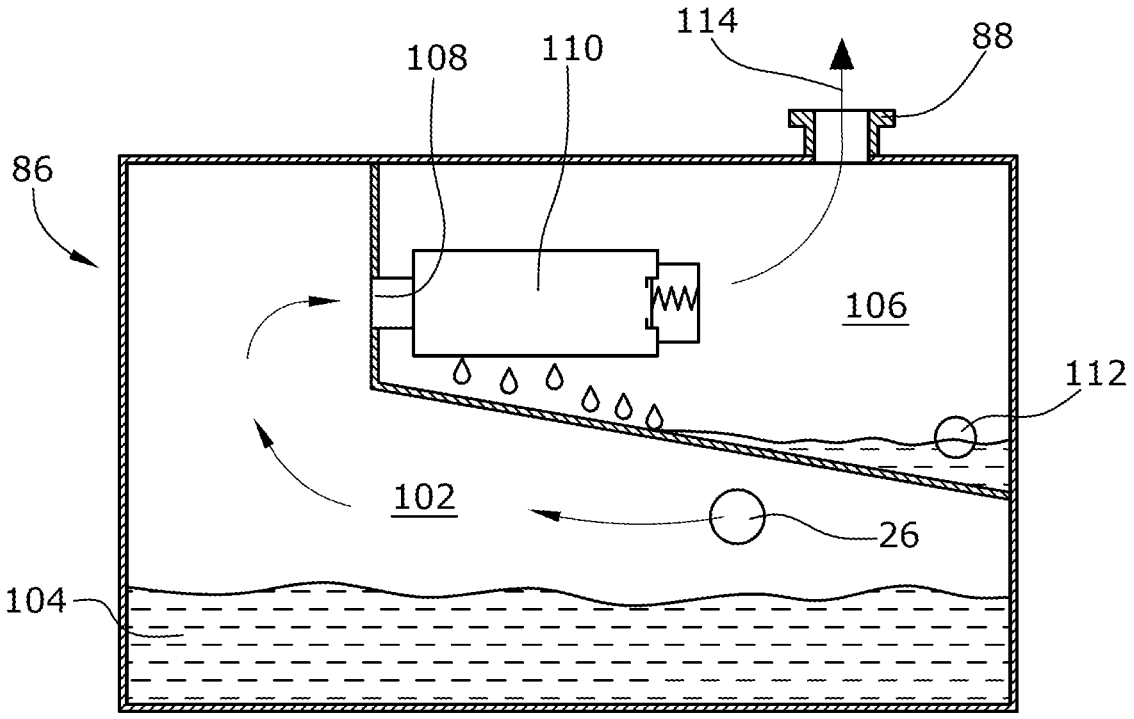
FIG. 6 is a schematic sectional view of an oil reservoir.

Through the outlet 26 of the last suction chamber 82, the oil/gas mixture will flow into the oil reservoir 86 (FIG. 6). In the process, the oil/gas mixture will first flow into an oil chamber 102 of oil reservoir 86. Within oil chamber 102, oil 104 will be collected under the effect of gravity. The remaining mixture of oil and gas will flow from oil chamber 102 into the filtering chamber 106. The oil/gas mixture will, in doing so, immediately enter via an inlet 108 into a filtering device 110 arranged in filtering chamber 106. With the aid of said filtering device 110, oil will be filtered out which will be returned again to the oil circuit via a return channel 112. The remaining gas which has been purged of oil will flow out through the outlet 88 of the vacuum pump as indicated by arrow 114.

The invention claimed is:

1. A multi-stage rotary vane pump, comprising:

a one-piece housing element extending along an axial direction, the one-piece housing element having a first open end and a wall opposite the first open end;

a subassembly comprising a rotor shaft having two rotor elements integrally formed therewith, two partition wall elements connected to one another in a space between the two rotor elements, and a sliding vane arranged in a slot of each of the two rotor elements, the subassembly being sized and configured for insertion into the housing element through the first open end;

a housing lid closing the first open end;

a first suction chamber defined around a first of the two rotor elements; and a second suction chamber defined around a second of the two rotor elements, wherein the first suction chamber is defined within the housing lid, the housing element, and a first face formed by the two partition wall elements, the rotor shaft passing through and being supported by the housing lid and passing through without being supported by the two partition wall elements, and wherein the second suction chamber is defined within the wall, the housing element, and a second face formed by the two partition wall elements, the rotor shaft passing through without being supported by the wall.

2. The multi-stage rotary vane pump according to claim 1, further comprising centering elements that are provided on abutment faces of the partition wall elements.

3. The multi-stage rotary vane pump according to claim 1, housing element further comprises an inlet connected to the first suction chamber and an outlet connected to a second suction chamber.

4. The multi-stage rotary vane pump according to claim 3, further comprising an oil reservoir arranged between the second suction chamber and the outlet so that a gas/oil mixture flows from the second suction chamber into the oil reservoir.

5. The multi-stage rotary vane pump according to claim 4, wherein the oil reservoir is arranged laterally beside the multi-stage rotary vane pump.

6. The multi-stage rotary vane pump according to claim 4, wherein the oil reservoir comprises two mutually connected chambers, wherein one of the mutually connected chambers is formed as an oil chamber in which the gas/oil mixture exiting from the second suction chamber is captured.

7. The multi-stage rotary vane pump according to claim 6, wherein the other of the two mutually connected chambers is formed as a filtering chamber for separating oil and gas, wherein the filtering chamber is arranged behind the oil chamber as viewed in a flow direction.

8. The multi-stage rotary vane pump according to claim 7, wherein the filtering chamber comprises a filtering device connected to an inlet of the filtering chamber.

9. The multi-stage rotary vane pump according to claim 8, wherein the filtering chamber is connected to a vacuum pump outlet.

10. The multi-stage rotary vane pump according to claim 7, wherein the filtering chamber is connected to a vacuum pump outlet.

11. The multi-stage rotary vane pump according to claim 1, wherein the two partition wall elements are formed as two segments shaped as half rings.

12. The multi-stage rotary vane pump according to claim 1, wherein the partition wall elements are non-concentric.

13. The multi-stage rotary vane pump according to claim 1, further comprising a first blower wheel carried by a portion of the rotor shaft that passed through the housing lid.

14. The multi-stage rotary vane pump according to claim 1, wherein the housing element extends past the wall along the axial direction to a second open end to define a motor chamber.

15. The multi-stage rotary vane pump according to claim 14, further comprising:

an electric motor connected to the rotor shaft in the motor chamber; and a bearing plate closing the second open end, the bearing plate comprising a bearing element supporting the rotor shaft.

16. The multi-stage rotary vane pump according to claim 15, further comprising a second blower wheel carried by a portion of the rotor shaft that passed through the bearing plate.

* * * * *